United States Patent [19]

Crunk et al.

[11] 4,123,034

[45] Oct. 31, 1978

[54] BOX FORM FOR CONCRETE CULVERT

[75] Inventors: Elmer Kenneth Crunk; John W. Craft, both of Jonesboro, Ark.

[73] Assignee: BC Pausch, Inc., Jonesboro, Ark.

[21] Appl. No.: 768,029

[22] Filed: Feb. 14, 1977

Related U.S. Application Data

[63] Continuation-in-part of Ser. No. 743,789, Nov. 22, 1976, abandoned.

[51] Int. Cl.[2] ..... B28B 7/00

[52] U.S. Cl. ..... 249/156; 249/100; 249/165

[58] Field of Search ..... 249/11, 12, 100, 155, 249/156, 160, 163–169; 220/4 R, 4 B, 4 E, 5 A

[56] References Cited

U.S. PATENT DOCUMENTS

| | | | |
|---|---|---|---|
| 975,615 | 11/1910 | Hanneman | 249/156 |
| 1,374,864 | 4/1921 | Rashkousky | 249/165 |
| 1,602,036 | 10/1926 | Miller | 249/100 |
| 1,871,919 | 8/1932 | Schubert | 249/166 |
| 3,099,062 | 7/1963 | Bauer | 249/155 |
| 3,582,034 | 6/1971 | Tsuzuki | 249/160 |

FOREIGN PATENT DOCUMENTS

| | | | |
|---|---|---|---|
| 1,346,957 | 2/1974 | United Kingdom | 249/165 |

*Primary Examiner*—Francis S. Husar
*Assistant Examiner*—John McQuade
*Attorney, Agent, or Firm*—Burd, Braddock & Bartz

[57] ABSTRACT

A box form used in a dry cast system for making a concrete box culvert. The form has a pair of wall sections secured together with a pair of corner units. The corner units can be removed from the wall sections and replaced with different sized corner units to change the size of the complete form. Spacers can be interposed between the corner units and wall sections to change the wall thickness of the box culvert. The form is carried on a pallet assembly having members for accommodating lift structures of a fork life vehicle. The pallet assembly is a rectangular structure having a stepped pallet and upright guide members. The guide members cooperate with rails on lower portions of the form to locate the form on the pallet assembly. The pallet assembly and form surround a box core providing a box chamber for receiving the concrete mix forming a concrete box culvert.

42 Claims, 19 Drawing Figures

FIG. 11
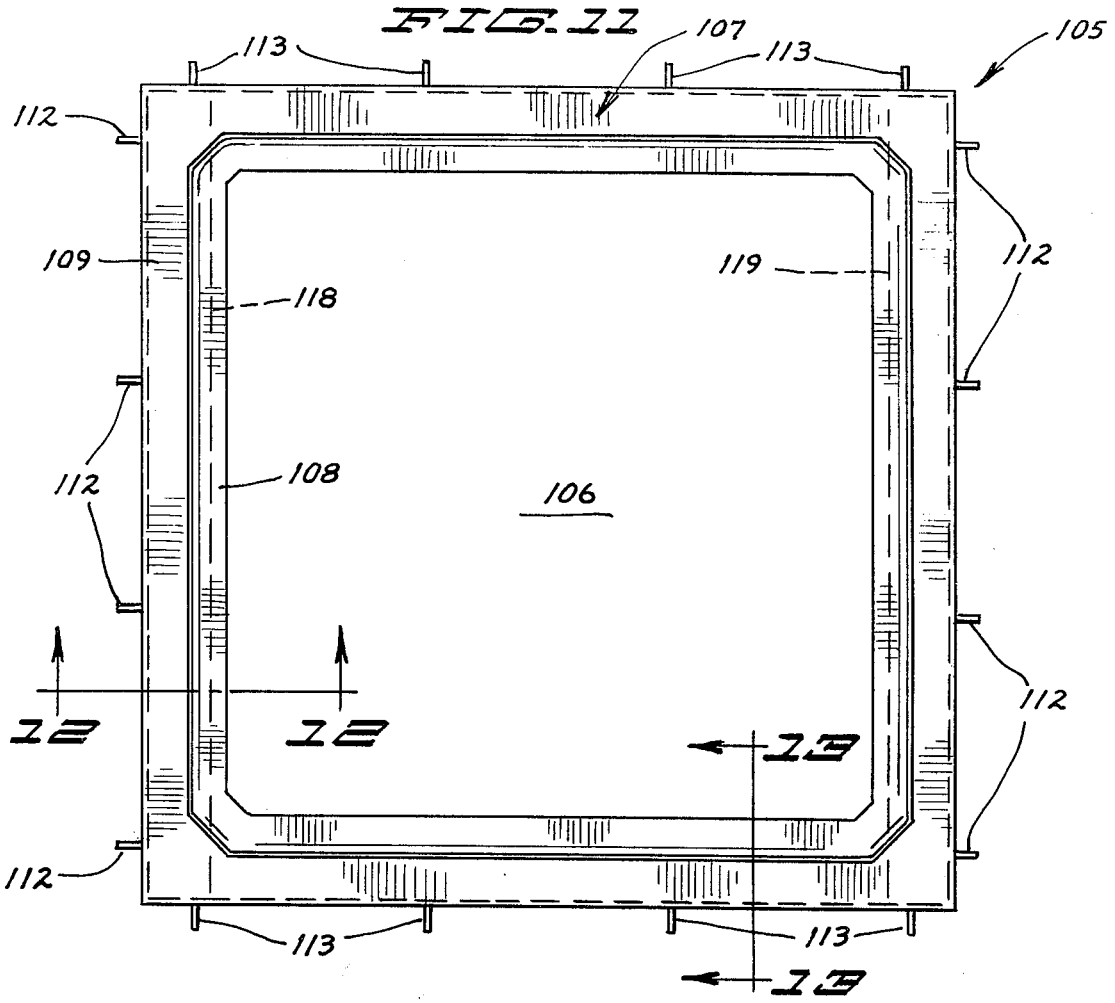
FIG. 12
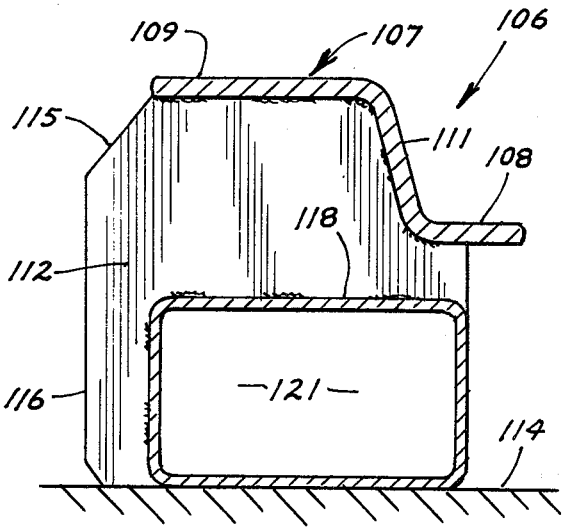
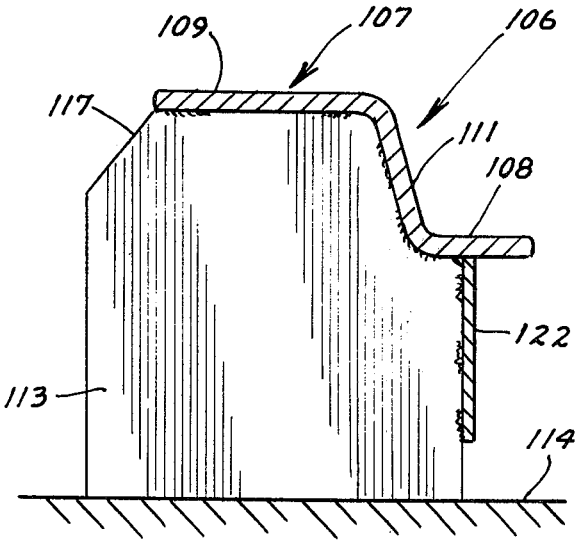
FIG. 13

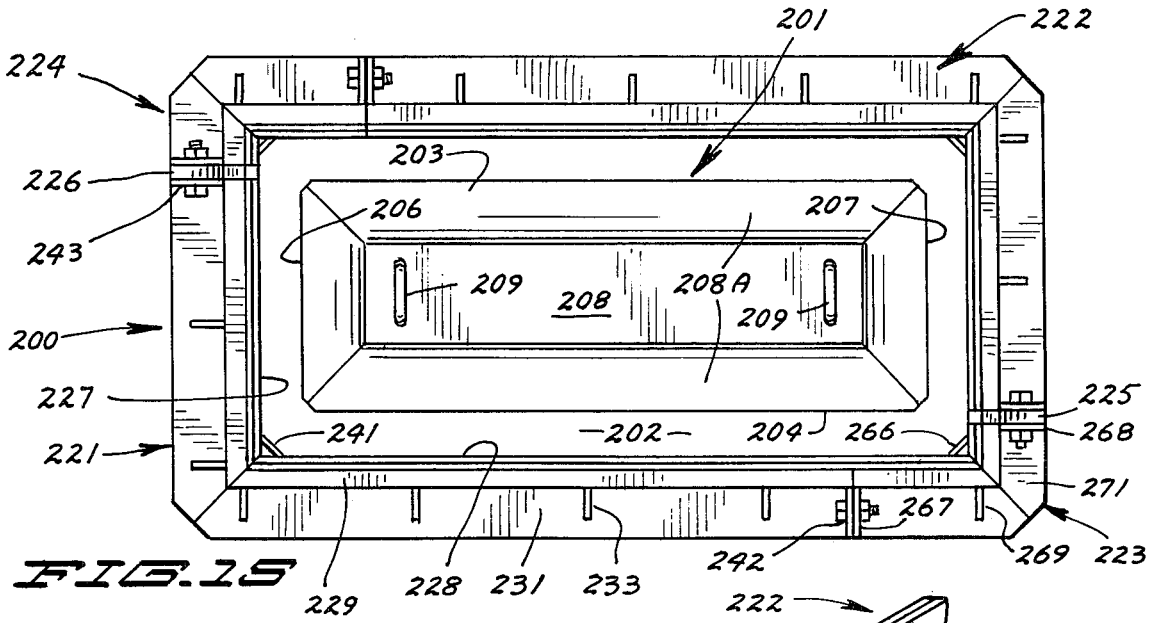
FIG. 15
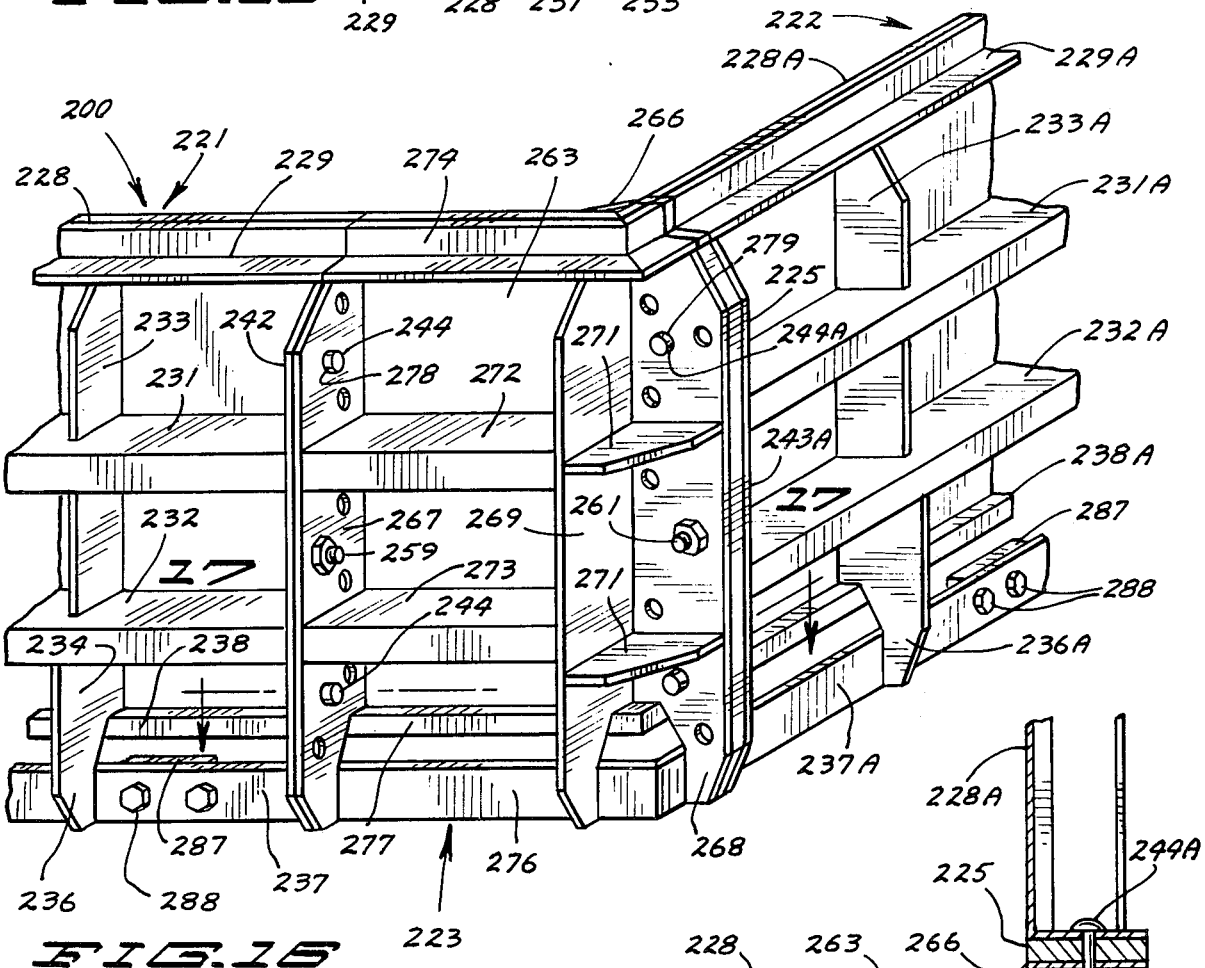
FIG. 16
FIG. 17

BOX FORM FOR CONCRETE CULVERT

CROSS REFERENCE TO RELATED APPLICATION

This application is a continuation-in-part of U.S. application Ser. No. 743,789 filed Nov. 22, 1976, now abandoned.

BACKGROUND OF THE INVENTION

Cast-in-place box culverts are used with pipe for handling drainage water and sewage. Box culverts provide a large area of flow in a relatively small space. Many construction projects, such as supermarkets and malls, require 1,500 to 3,000 feet of box culverts. It is conventional construction to dig the necessary trenches and cast the box culverts in place. This is a time consuming and costly project. Cast-in-place box culverts require forms that are reinforced and placed in the trenches. Concrete mix is transported by trucks to the job site and placed in the forms to make the box culvert. After the concrete has set the forms are removed. Fabrication of a cast-in-place box culvert is subject to adverse weather conditions and in many cases difficult accessibility to the job site.

Wet pre-cast concrete box culverts were developed for fabrication in the plant and then hauled to the job site. The wet cast system of making a culvert has a disadvantage in that considerable time is necessary before the jackets and cores can be removed from the wet concrete culvert. This requires a substantial investment in box forms and produces a relatively low production rate, thereby making a long run contract expensive.

SUMMARY OF THE INVENTION

The invention is generally related to form structures used in the manufacturing of concrete products, as box culverts, pipes, and the like. A dry cast process is used to make concrete box culverts. The dry cast process uses inner and outer forms that are removed immediately from the dry cast concrete culvert for reuse in making additional culverts. The outer form has a pair of right angle wall sections connected at their opposite ends to first and second corner units to complete the box shaped outer form. The corner units have different angle shapes and lengths whereby the size of the complete form can be changed. The same angle sections are used in the different sized outer form. This allows for a wide range of box form sizes with a minimum capital investment in forms and tooling. The corner units are easily removed from the right angle sections and replaced with different corner units when it is necessary to change the box culvert size. Spacer plates can be used between the corner units and angle sections to change the wall thickness of the concrete product.

The outer form is used in combination with a pallet assembly and core to form the concrete box culvert. The pallet assembly has a pair of box members having passages to receive the forks of a fork lift transporting vehicle. The pallet assembly also has guide members cooperating with a lower portion of the outer form to position the outer form on the pallet assembly around a box core.

The box culvert forms are usable with various types of culvert production systems. The outer form or the core can be initially stripped from the finished box culvert and the concrete box culvert and remaining form is moved to a storage location. The remaining form is then stripped from the concrete box culvert, leaving the concrete box culvert supported by the pallet assembly. The inner and outer forms are then used to make additional box culverts. The pallets of the pallet assemblies and headers may be constructed with either the tongue end or the groove end at the top of the form.

An object of the invention is to provide a box form for use in making concrete box culverts that is versatile and accurate in use, requires a low investment and has the economy of fast production of concrete box culverts. Another object of the invention is to provide a box form with replaceable corner units which allow a box form to be adjusted in size at a low cost and in a minimum amount of time. A further object of the invention is to provide a box culvert form used in association with a pallet assembly and a core to make pre-cast concrete box culverts by a dry cast process. These and other objects of the box forms for making concrete block culverts are embodied in the following detailed description of preferred embodiments of the invention.

IN THE DRAWINGS

FIG. 11 is a top plan view of a pallet assembly used with the box form of FIG. 1 in the making of a concrete box culvert;

FIG. 12 is an enlarged sectional view taken along the line 12—12 of FIG. 11;

FIG. 13 is an enlarged sectional view taken along the line 13—13 of FIG. 11;

FIG. 15 is a top plan view of a fourth modification of an adjustable box outer form surrounding a box core for making a concrete box culvert;

FIG. 16 is an enlarged fragmentary perspective view of a corner portion of the outer form of FIG. 15;

FIG. 17 is a sectional view taken along line 17—17 of FIG. 16;

DESCRIPTION OF PREFERRED EMBODIMENTS

Figure 1:
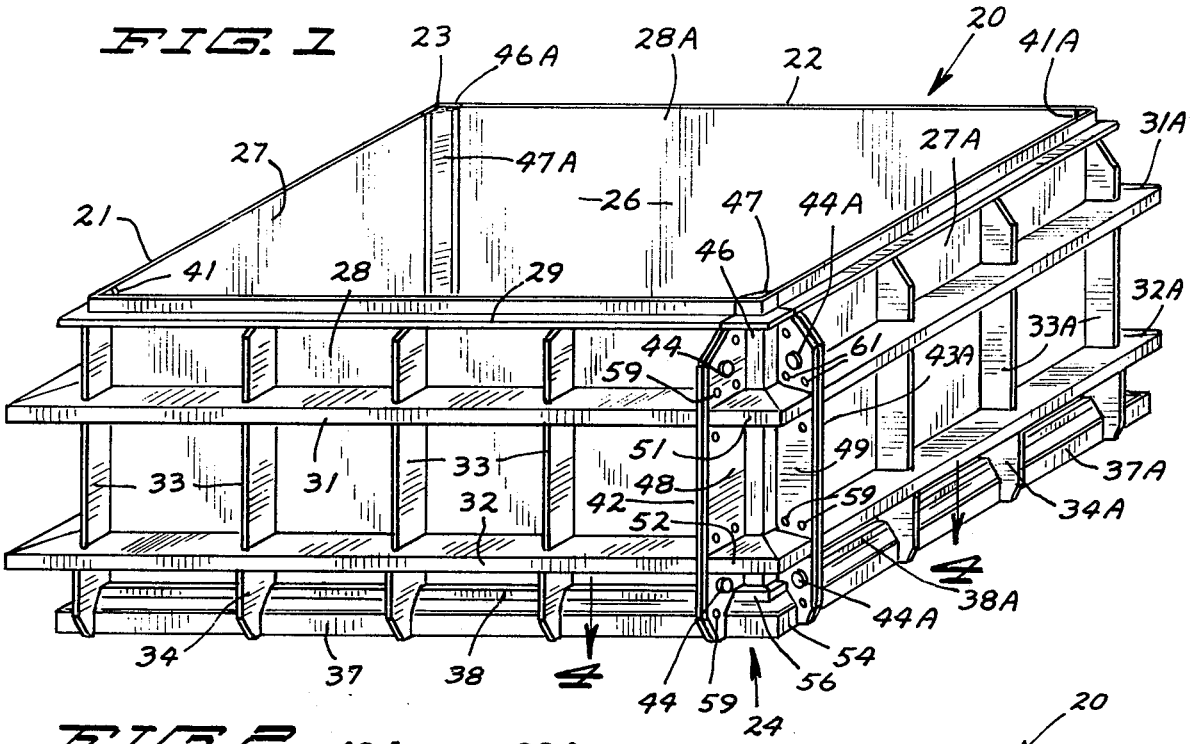
FIG. 1 is a perspective view of a first modification of an adjustable box outer form used in making a concrete box culvert.
Figure 2:
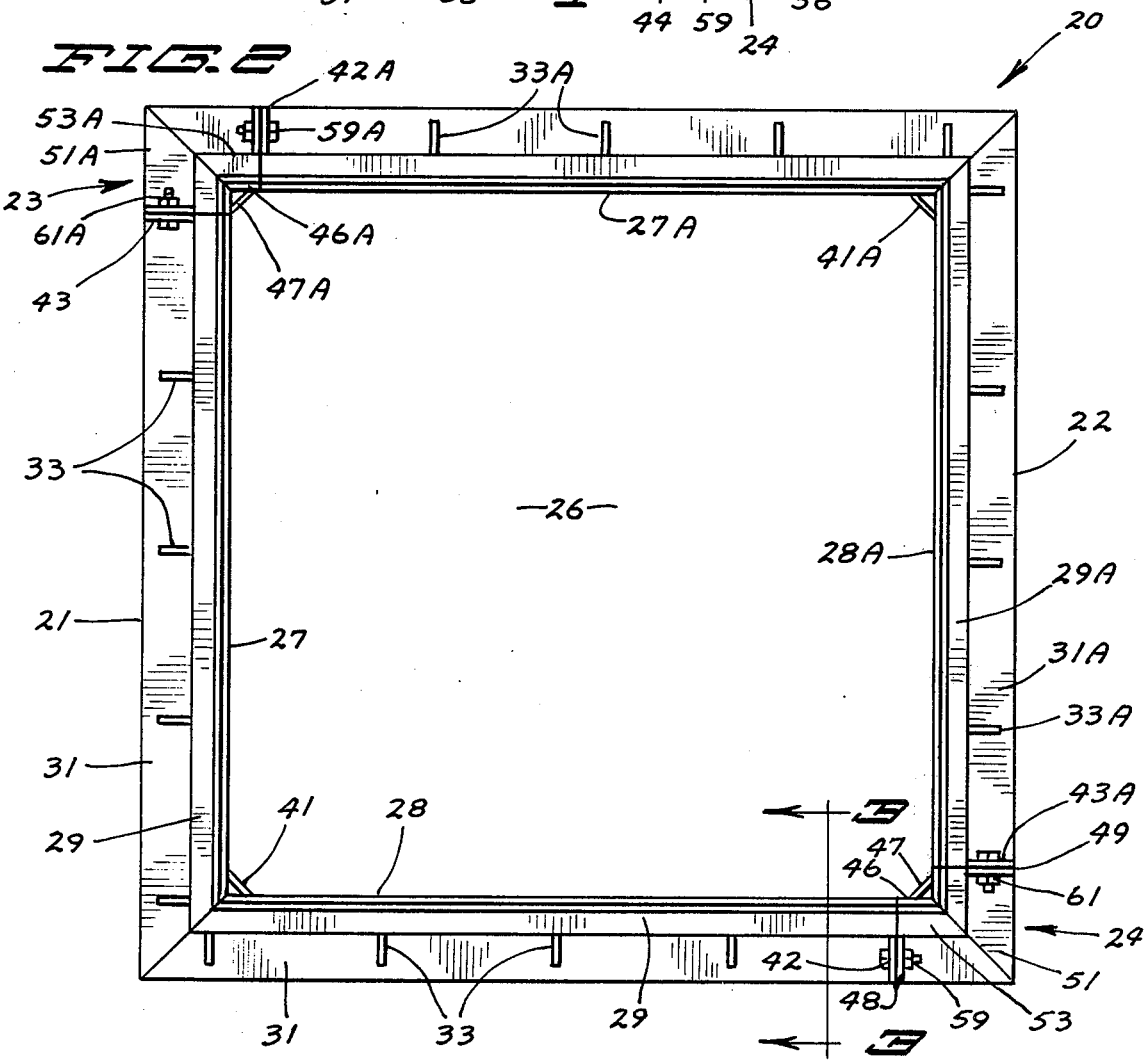
FIG. 2 is a top plan view of FIG. 1.

A first box form or jacket of the invention is indicated generally at 20 in FIGS. 1 and 2. Form 20 comprises two right angle wall sections 21 and 22. A first corner unit 23 connects first ends of sections 21 and 22. In a similar manner, a second corner unit 24 connects the opposite adjacent ends of sections 21 and 22. Sections 21 and 22 and corner units 23 and 24 connected together provide a rectangular box structure that is used to make the outer surface of a rectangular concrete pipe or box culvert. Sections 21 and 22 with corner units 23 and 24 surround a generally rectangular space or chamber 26 for accommodating a core or inner form used to make the inner surface of the pipe wall or box culvert. Each section 21 and 22 is shown as having a right angle or 90° shape. Sections 21 and 22 can have other angles, acute or obtuse angles, and can have more than one angle.

Figure 3:
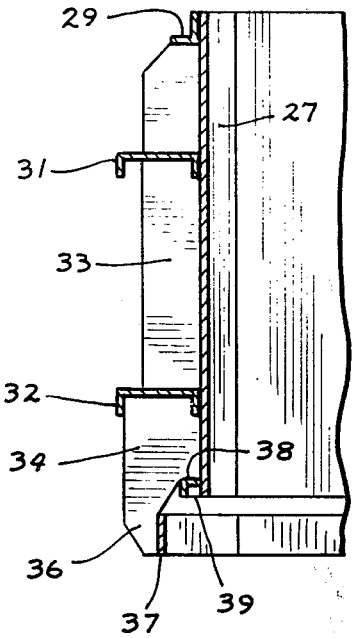
FIG. 3 is an enlarged sectional view taken along the line 3—3 of FIG. 2.

First wall section 21 has first and second flat upright walls 27 and 28 angularly disposed 90° relative to each other. Walls 27 and 28 are metal plates, such as heavy sheet steel. A right angle member 29 is secured to the outer side of the upper edge of walls 27 and 28 with suitable fasteners such as welds, nuts and bolts, clamp assemblies, and the like. A pair of horizontal channel beams 31 and 32 are located adjacent the outside surfaces of walls 27 and 28 and are attached to spaced upright ribs 33. Beams 31 and 32 are fixed by welds to walls 27 and 28. Alternatively, beams 31 and 32 may be free of walls 27 and 28 whereby the walls can have limited movement independent of the beams. Ribs 33 extend downwardly from angled member 29 to the top of channel beam 32. As shown in FIG. 3, upright plates 34 aligned with ribs 33 are secured to the lower side of channel beam 32. Plates 34 may be extensions of the bottoms of ribs 33. Each plate 34 has a downwardly directed extension or foot 36. A horizontal rail or guide plate 37 is attached to the inside of each extension 36. The guide plate 37 is located outwardly from walls 27 and 28 and functions to guide and position the outer form 20 on a pallet assembly 105. The pallet assembly 105 is hereinafter described.

A right angle member 38 is located along the inside lower edge of the walls 28 and 29 and is secured to plates 34. The right angle member 38 forms a downwardly open groove 39 with the lower edge of walls 27 and 28.

Returning to FIGS. 1 and 2, an upright corner strip or fillet 41 is located in the corner formed by the adjacent ends of the walls 27 and 28. Corner strip 41 provides the concrete box culvert with a beveled corner.

First section 21 has an upright flat end plate 42 secured to the first ends of channel beams 31 and 32, wall 28 and angle member 29. The opposite end of section 21 has a second end plate 43 secured to the end of wall 27 and adjacent portions of angle member 29 and beams 31 and 32. The lower ends of the end plates 42 and 43 are secured to ends of the guide rail 37. End plate 42 carries a pair of outwardly directed horizontal studs or positioning members 44 for aligning corner unit 24 on plate 42.

Section 22 is identical in structure to the section 21. The parts of section 22 that correspond to the parts of section 21 have the same reference numerals with the suffix A.

Corner units 23 and 24 are located in diagonally opposite positions and are identical in structure. The following description is limited to corner units 24. Like parts of corner unit 23 that are identical with the parts of corner unit 24 have the same reference numerals with the suffix A.

Corner unit 24 has an upright right angle member 46 having flanges that are aligned with walls 28 and 28A. An upright corner strip or fillet 47 is secured to the inside of the flanges to provide the concrete culvert with a beveled or chamfered corner. A first end or connector plate 48 is attached to one flange of the angle member 46 and is located in face-to-face engagement with end plate 42. The opposite flange of angle member 46 is secured to a second upright flat end or connector plate 49. Plate 49 is located in face-to-face engagement with end plate 43A. A pair of right angle channel beams 51 and 52 extend horizontally between and are secured to the plates 48 and 49. A right angle top beam 53 is located over the top of plates 48 and 49 and is secured to member 46 and plates 48 and 49. A right angle bottom guide rail 54 is secured to lower or bottom ends of plates 48 and 49. Guide rail 54 is a right angle member and in alignment with the guide rails 37 and 37A. A right angle member 56 is aligned with angle members 38 and 38A to form a continuation of groove 39. Angle member 56 is secured to plates 48 and 49 and lower end of angle member 46 by welds or the like.

Figure 4:
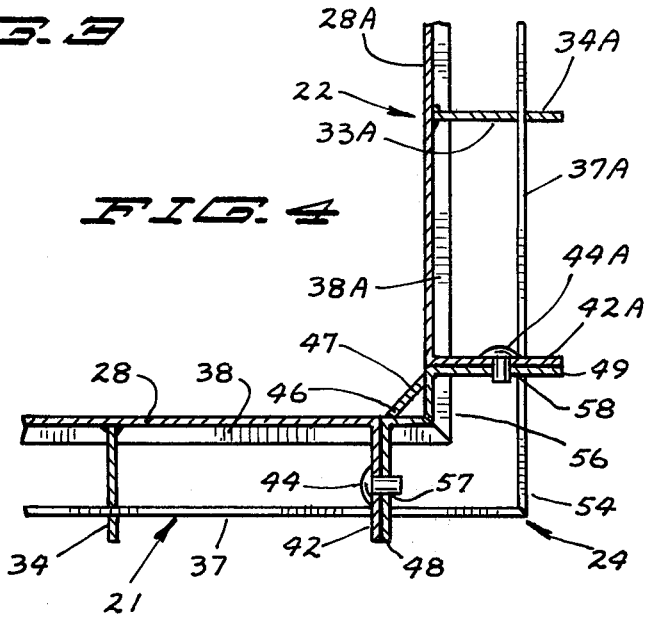
FIG. 4 is an enlarged sectional view taken along the line 4—4 of FIG. 1.

Referring to FIG. 4, plate 48 has holes 57 for accommodating studs 44. Similar holes 58 are provided in plates 49 to accommodate studs 44A. Studs 44 and 44A align and hold the corner unit 24 in engagement with end plates 42 and 42A of sections 21 and 22. Additional studs and holes can be used to locate corner units 24 on wall sections 21 and 22. The studs can be attached to plates 48 and 49 with the holes in end plates 42 and 43. As shown in FIG. 3, a plurality of nut and bolt assemblies 59 extend through aligned holes in the plates 42 and 48 to secure the plates together. Similar nut and bolt assemblies 61 extend through aligned holes in plates 42A and 49 to hold the corner unit 24 in engagement with section 22. Nut and bolt assemblies 59 and 61 are removed to allow corner unit 24 to be separated from wall sections 21 and 22. Nut and bolt assemblies 59 and 61 have been removed from corner unit 24 in FIG. 1.

Figure 5:
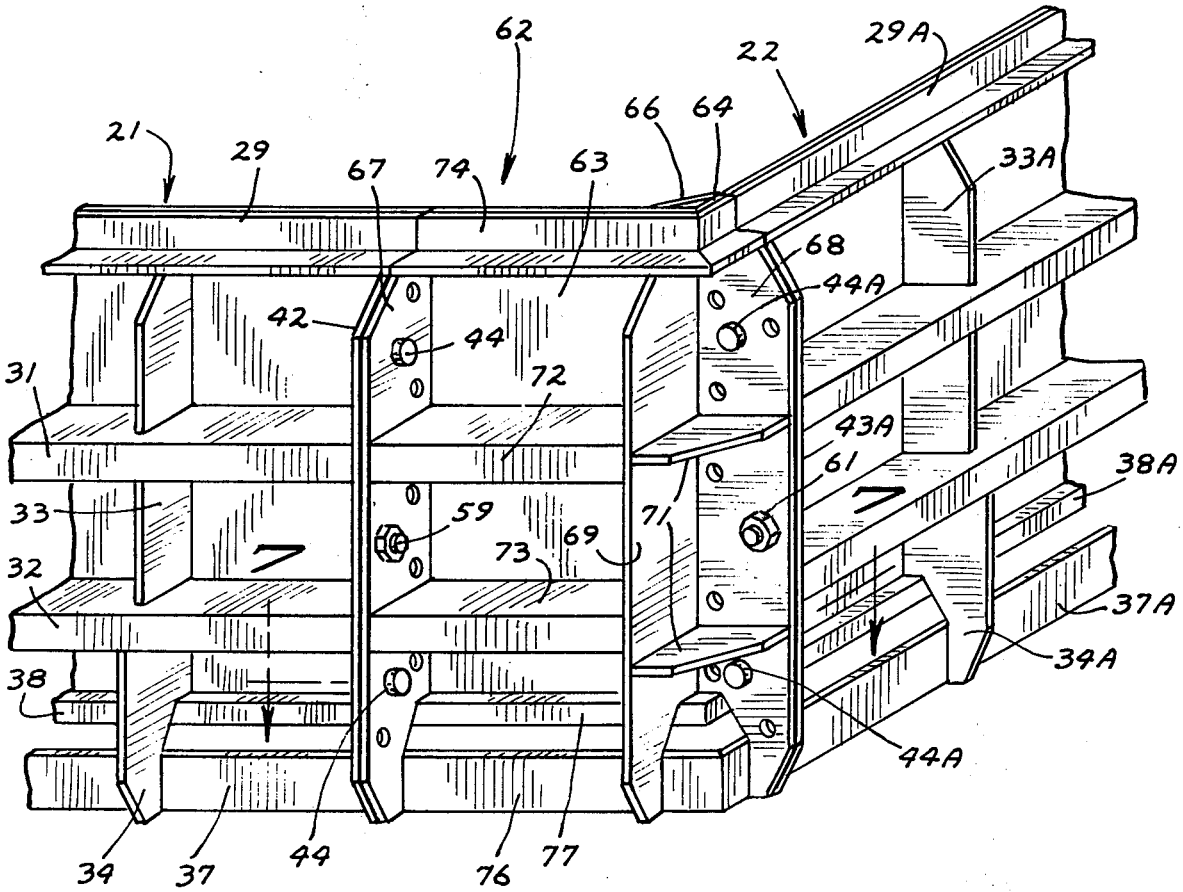
FIG. 5 is a fragmentary perspective view of a corner portion of a second modification of an adjustable box outer form usable to make concrete box culverts.
Figure 6:
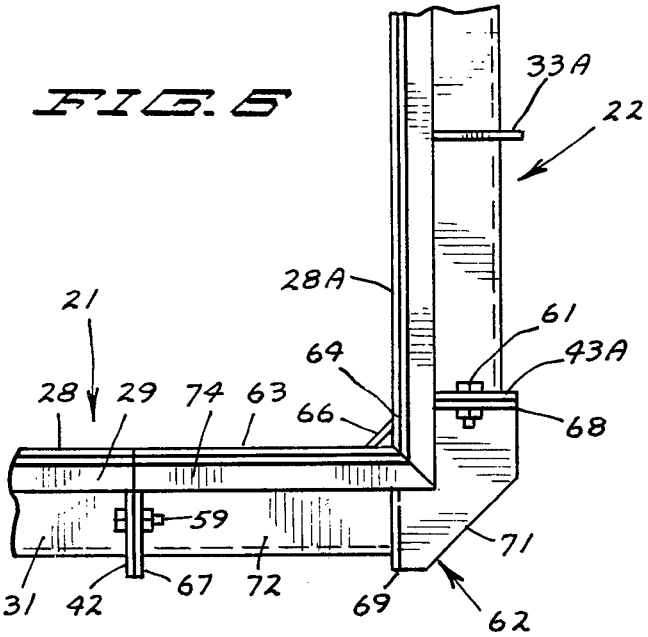
FIG. 6 is an enlarged top plan view of FIG. 5.
Figure 7:
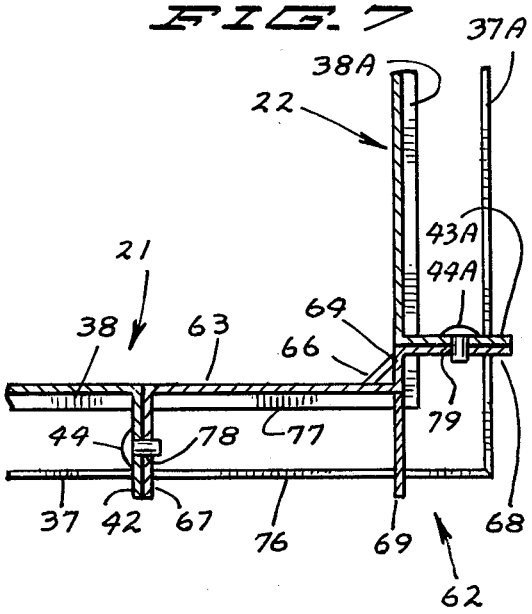
FIG. 7 is an enlarged sectional view taken along the line 7—7 of FIG. 5.

Referring to FIGS. 5, 6 and 7, there is shown a modification of a corner unit indicated generally at 62 in assembled relation with right angle sections 21 and 22 to form a complete rectangular structure that is larger than the rectangular shape of form 20. Corner unit 62 has an upright wall 63 having a short right angle flange 64. Flange 64 and adjacent wall portion form a corner. A corner strip or fillet 66 is attached to flange 64 and wall 63 to form the chamfered or beveled corner of the concrete box culvert. Corner unit 62 has upright flat end plates 67 and 68 and an upright rib 69. End plates 67 and 68 have holes for accommodating nut and bolt assemblies 59 and 61, shown in FIG. 5. Additional nut and bolt assemblies are used to firmly connect corner unit 62 to sections 21 and 22. As shown in FIG. 7, rib 69 is located in alignment with flange 64 at the end of wall 63. A pair of gusset members 71 extend between and are secured to spaced portions of the ribs 69 and end plate 68. A pair of channel beams 72 and 73 extend between and are secured to end plate 67 and rib 69. Channel beams 72 and 73 may be secured with welds or the like to the outside of wall 63. Alternatively, wall 63 may not be secured to the channel beams 72 and 73, thereby allowing the wall to have independent limited movement relative to channel beams 72 and 73.

A right angle top member 74 is secured to the top portions of plates 67 and 68 and rib 69. Member 74 is also secured to the top portion of wall 63. A right angle bottom guide rail 76 is secured to the lower portions of plates 67 and 68 and rib 69. Positioned above and inwardly of guide rail 76 is angle member 77 having a continuous downwardly open groove. Angle member 77 is secured to the plate 67 and 68 and rib 69 and is in alignment with the right angle members 38 and 38A.

As shown in FIG. 7, plate 67 has a hole 78 for accommodating stud 44. Plate 68 has similar holes 79 for accommodating the studs 44A. The nut and bolt assemblies 59 and 61 secure the end plate 67 to the plate 42 and the end plate 68 to the plate 43A respectively.

Figure 8:
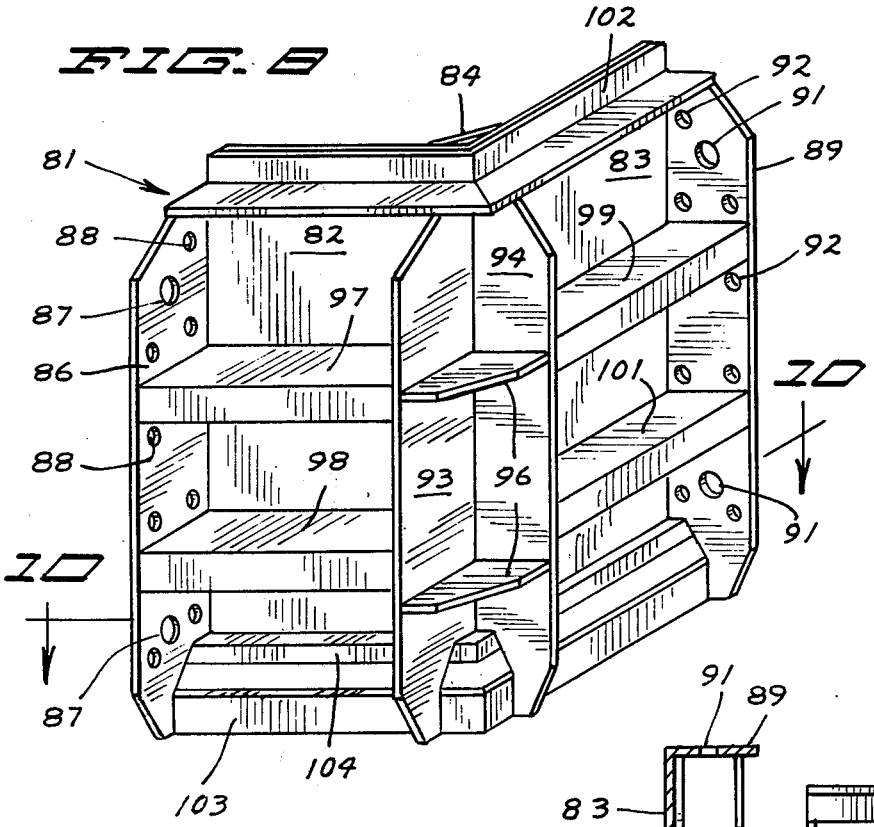
FIG. 8 is a fragmentary perspective view of a corner portion of a third modification of an adjustable box outer form usable to make a concrete box culvert.
Figure 9:
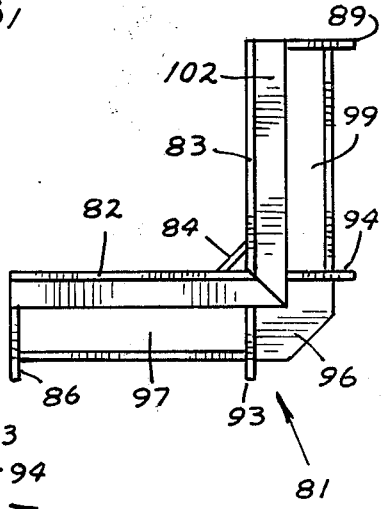
FIG. 9 is an enlarged top plan view of FIG. 8.
Figure 10:
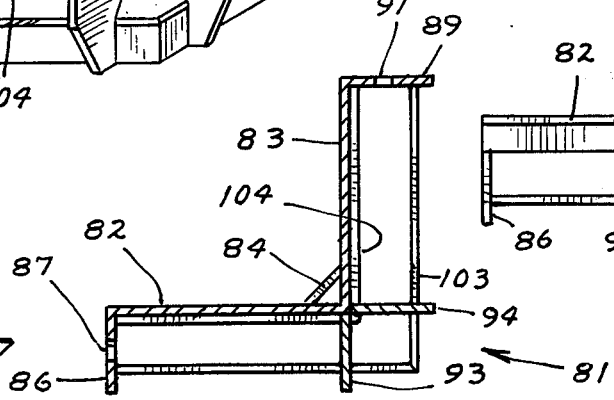
FIG. 10 is an enlarged sectional view taken along the line 10—10 of FIG. 9.

Referring to FIGS. 8, 9 and 10, there is shown a third modification of the corner unit indicated generally at 81. The corner unit 81 has two flat upright walls 82 and 83 positioned at right angles relative to each other. Walls 82 and 83 have the same rectangular size. The length of walls 82 and 83 can be different whereby one side of corner unit 62 is longer than the other side. The adjacent ends of the walls 82 and 83 are secured together and are secured to an upright corner strip or fillet 84. Fillet 84 forms the beveled or chamfered corner of the concrete box culvert.

Corner unit 81 has upright first end plate 86 having a pair of stud holes 87 and holes 88 for accommodating nut and bolt assemblies used to secure the end plate to a right angle section of the form. The opposite end of corner unit 81 has a second upright end plate 89. End plate 89 has a pair of stud holes for accommodating the locating studs 44A and additional holes 92 for accommodating the nut and bolt assemblies 61. A pair of upright ribs or flanges 93 and 94 are secured to the outside adjacent ends of the walls 82 and 83. A pair of gusset plates 96 are located between the ribs 93 and 94 and hold the ribs 93 and 94 in a right angle relation relative to each other. A first pair of channel beams 97 and 98 extend horizontally between the end plate 86 and rib 93 and are secured thereto. In a similar manner, a second pair of channel beams 99 and 101 extend between the end plate 89 and rib plate 94 and are secured thereto. Channel beams 97–101 are secured by welds or the like to the walls 82 and 83 respectively. Alternatively, channel beams 97–101 may be free of walls 82 and 83 whereby the wall can have limited movement and vibrations independent of the channel beams.

Top member 102 is secured to top portions of walls 82 and 83 and the tops of end plates 86 and 87 and ribs 93 and 94. A guide rail 103 is secured to the lower ends of end plates 86 and 89 and ribs 93 and 94. Positioned above and inwardly of guide rail 103 is an angle member 104 having a downwardly open groove. The angle member 104 is secured to the walls 82 and 83 and the end plates 86 and 89 as well as ribs 93 and 94.

Referring to FIG. 11, there is shown a pallet assembly indicated generally at 105, having a rectangular opening 106 for accommodating the inner form or core. Pallet assembly 105 has a rectangular pallet or top member 107 surrounding opening 106. Pallet 107, as shown in FIGS. 12 and 13, has an inside lip or flange 108 and an outside flange 109. Flange 109 is at a higher elevation than flange 108. A downwardly curved midsection 111 connects flanges 108 and 109. The sides of the pallet 107 are connected to downwardly directed supports or legs 112 that rest on the floor or support surface 114. The ends of pallet 107 are connected to downwardly directed supports or legs 113. Legs 113 also engage the supporting surface 114. Legs 112 have downwardly and outwardly inclined upper outside corners 115 which lead from the outer edge of flange 109 to the outside upright edge 116 of the legs 112. As shown in FIG. 13, legs 113 have downwardly and outwardly inclined or beveled corners 117 that extend from the outside edge of flange 109 to the outside edge of legs 113.

Returning to FIGS. 11 and 12, a pair of longitudinal box beams 118 and 119 are secured to legs 112 and engage the supporting surface 114 Box beam 119 has the same shape as box beam 118 shown in FIG. 12. Box beams 118 and 119 have longitudinal passages 121 for accommodating the lift structures or fingers of a fork lift vehicle. Box beams 118 and 119 extend generally parallel to each other. Opposite ends of the box beams 118 and 119 are connected to cross plates 122. The inside edges of legs 113 are also secured by welds or the like to cross plates 122.

Figure 14:
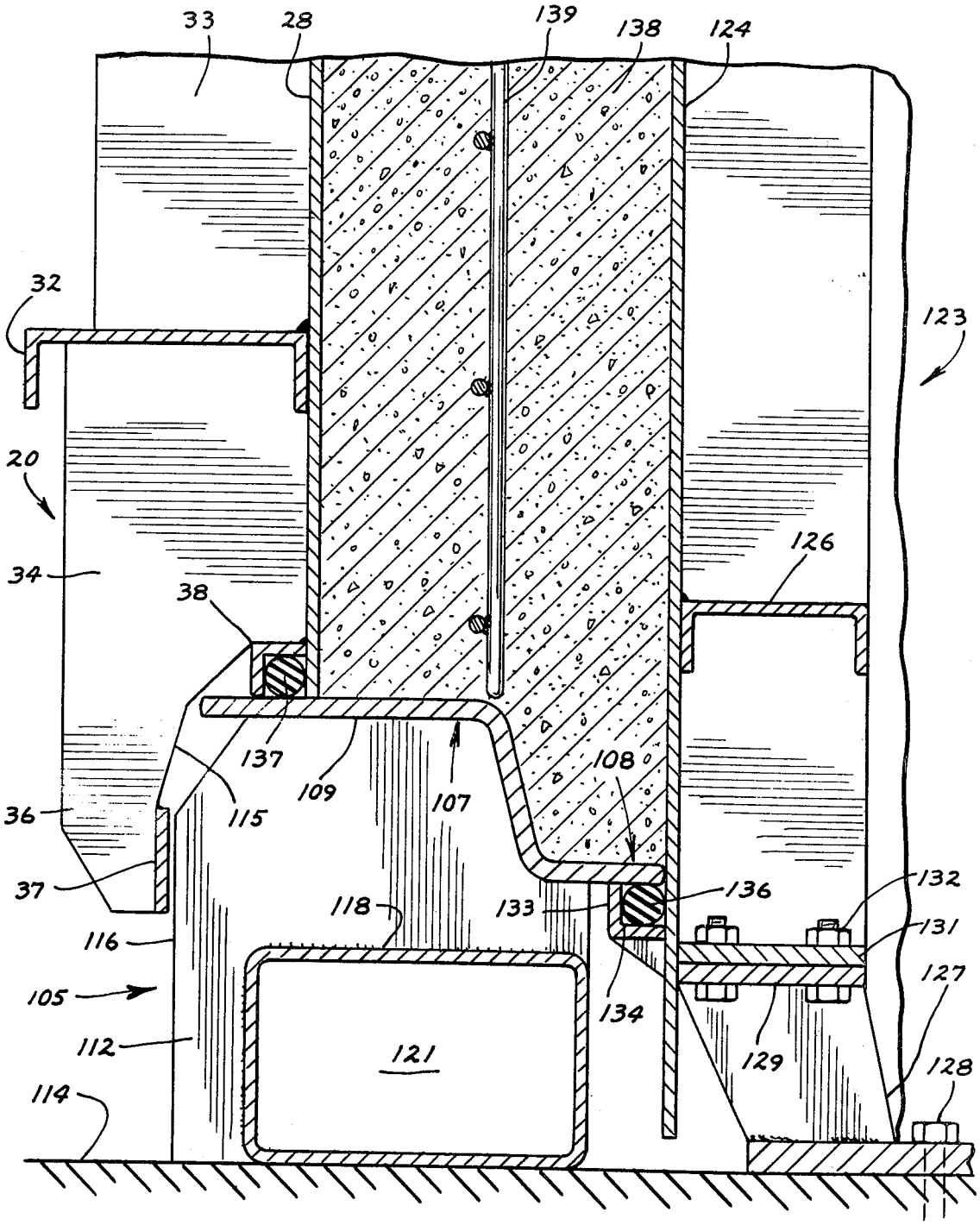
FIG. 14 is a fragmentary vertical sectional view of a box core, pallet assembly and box outer form in assembled relation for making a concrete box culvert.

Referring to FIG. 14, there is shown a vertical cross section of a bottom portion of outer form 20 mounted on pallet assembly 105 in assembled relation with a core or inner form indicated generally at 123. Core 123 has an upright side wall 124. Wall 124 has a generally rectangular or box shape and is spaced inwardly from the walls of the outer form providing a box chamber or space for accommodating concrete mix. The top of the core is closed with a top wall (not shown) which facilitates the movement of concrete into the space between the core 123 and outer form 20. The wall 124 is reinforced with a plurality of reinforcing beams 126 that extend around the core 124 and are secured to the inside portions of wall 124. Core 123 is mounted on a base 127. A plurality of fasteners 128 secure the base to support 114. Base 127 has an annular top member 129 providing a support for a bottom member or ring 131 of core 123. A plurality of fasteners 132 as nut and bolt assemblies, secure ring 131 to top member 129, whereby the core 123 is anchored to support 114.

Figure 19:
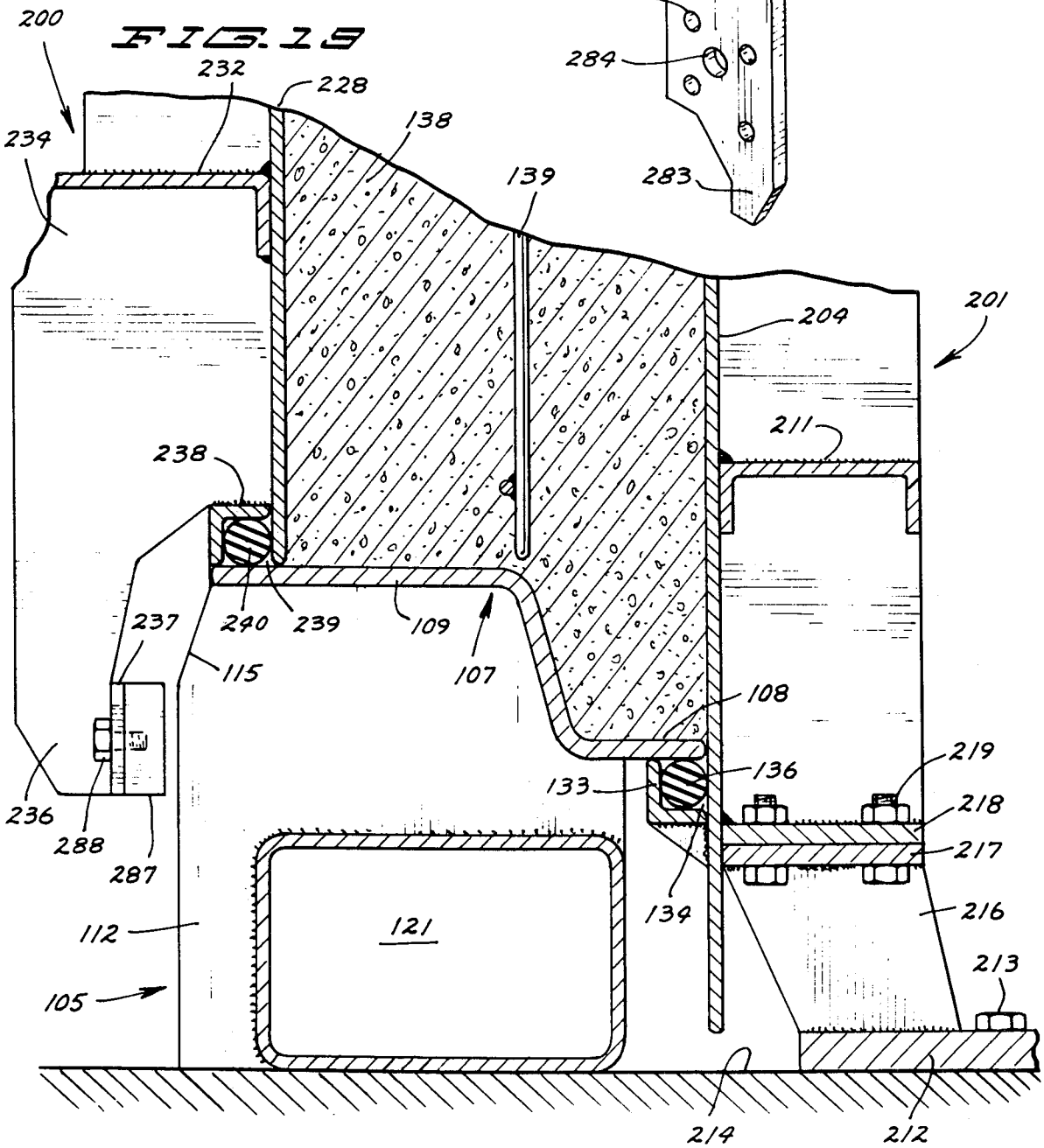
FIG. 19 is a fragmentary sectional vertical view of a box core, pallet assembly, and box outer form in assembled relation for making a concrete box culvert.

A right angle member 133 is secured to the lower portion of the outside core wall 124. Angle member 133 forms with the core wall 124 an upwardly open groove 134. A resilient seal 136, as a rubber O-shaped member, is located in groove 134 and engages the bottom side of inside flange 108 of the pallet 107. A similar resilient seal 137 is located in the groove formed by the angle member 38. Seal 137 engages the top of the outer pallet flange 109. Seal 137 is located inwardly of the outer edge of flange 109 so that the same pallet assembly 105 can be used with a larger outer form as shown in FIG. 19. The space between wall 28 and wall 124 is filled with concrete 138. The concrete surrounds a reinforcing cage 139 having a rectangular shape and being formed of a steel wire.

The procedure for making a box culvert with the form 20, pallet assembly 105 and core 123 is as follows. Core 123 is bolted to the support 114 with the bolts 128 at the location or station for controlled delivery of the concrete mix to the space between the wall 28 and core wall 124. Pallet assembly 105 is set around the core 123 with the inner flange 108 resting on resilient seal 136. Reinforcing cage 139 is then lowered around the core 123 onto pallet 107. Outer form 20 is then lowered over and down onto pallet 107. Guide rails 37 and 37A slide down the inclined outer edges 115 and 117 of the pallet legs 112 and 113 to position guide rail 137 in close engagement with the outside edges of the legs 112 and 113. The outer form rests on the resilient seal 137 which engages the outer portion of the pallet flange 109.

Latches (not shown) are moved to lock positions whereby the outer form 20 is locked to pallet assembly 105. The concrete mix is delivered to the space between the walls 28 and 124 above pallet 107. As the concrete box culvert is formed, both the outer form 20 and core 123 are vibrated with vibrators that are mounted on the outer form and core. The vibrators function to densify the concrete and eliminate air pockets or voids in the concrete.

The mating surface on the top of the concrete culvert is formed with a header (not shown) having a shape that is complementary to the shape of the pallet 107 whereby adjacent culverts can be connected together at the place of installation. In other words, the top of the culvert is provided with a groove to accommodate the tongue of the lower portion of another box culvert. Vibrators may be used with the header to densify the concrete at the top section of the culvert.

After the groove in the top of the culvert is formed, the header is removed and the outer form 20 and new box culvert and pallet assembly 105 are lifted from the core 123 and transported to a curing area. At the curing area, the pallet latches are released and the outer form 20 is stripped from the newly formed box culvert leaving only the box culvert supported on pallet assembly 105. The outer form 20 and core 123 can then be used for making another concrete box culvert.

Referring to FIG. 15, there is shown a fourth modification of the outer box form of the invention indicated generally at 200 concentrically positioned about a box core indicated generally at 201. Core 201 is spaced inwardly from the inside walls of form 200, forming a continuous rectangular space or chamber 202 for accommodating concrete to form a concrete box culvert.

Box core 201 is a rectangular structure having flat upright side walls 203 and 204 joined at their opposite ends to upright end wall 206 and 207. The top of core 201 is closed with a top wall 208. Top wall 208 has a downwardly and outwardly sloping side portions 208A to facilitate the movement of the concrete into space 202. A pair of upright ears 209 having holes are secured to opposite portions of top wall 208. Lifting structure (not shown) is connected to ears 209 to facilitate the movement of core 201.

Referring to FIG. 19, wall 204 is reinforced with a reinforcing beam 211. Beam 211 extends around the inside of walls 203, 204, 206, and 207 and is secured thereto by welds or the like. A plurality of beams are used to reinforce these walls. Core 201 is mounted on a base 212 resting on a support 214. A plurality of bolts 213 secure base 212 to support 214. A plurality of upright members 216 carried by base 212 are attached to a horizontal top member 217. A plate 218 secured to a lower portion of walls 203, 204, 206, and 207 rests on top member 218. A plurality of nut and bolt assemblies 219 secure member 218 to member 217.

Returning to FIGS. 15 and 16, box form 200 comprises two right angle wall sections indicated generally at 221 and 222, and first and second corner units 223 and 224. Corner unit 223 is releasably secured to opposite ends of the sections 221 and 222. A spacer plate 225 is interposed between corner unit 223 and the right angle section 222. A similar spacer plate 226 is interposed between corner unit 224 and right angle sections 221 and 222. Spacer plates 225 and 226 increase the thickness of the sides of space 202. Additional spacer plates can be interposed between the longitudinal connections of the corners units 223 and 224 with respect to the longitudinal portions of right angle sections 221 and 222 to increase the length of the space 202. The width of plates 225 and 226 can vary. Also, more than one spacer plate can be used to change the width of space 202.

Right angle sections 221 and 222 and corner units 223 and 224 are identical in structure to the right angle sections and corner units shown in FIGS. 5, 6, and 7. The corresponding parts have the same reference numerals with the prefix 2.

Sections 221 and 222 are identical in structure and are shown as having a right angle or 90° shape. The sections can have other angles, acute or obtuse, and can have more than one angle to form a desired shape of a concrete product. The first right angle section 221 has a pair of angularly disposed upright flat side walls 227 and 228. An angle member 229 is attached to the upper ends of the outside of walls 227 and 228. A pair of channel beams 231 and 232 vertically spaced adjacent the outside surfaces of side walls 227 and 228 reinforce the side walls. Beams 231 and 232 are fixed by welds to walls 227 and 228. Alternatively, beams 231 and 232 may be free of walls 227 and 228 whereby the walls can have limited movement independent of the beams. Ribs 233 extend downwardly from the angle member 229 to the top of beams 232. A plurality of upright plates 234 aligned with ribs 233 are secured to the lower side of beam 232. Plates 234 may be extensions of the bottom portions of ribs 233. Each plate 234 has a downwardly directed extension or foot 236 secured to a horizontal rail or guide plate 237. Guide plate 237 is located outwardly from walls 227 and 228 and functions to guide and position the outer form 200 on a pallet assembly of the type shown in FIGS. 11–13.

An inverted right angle member 238 is located along the inside of the lower edges of walls 228 and 229. Right angle member 238 forms with the side walls a downwardly open groove 239, shown in FIG. 19, for accommodating an O-ring or seal 240.

As shown in FIG. 15, an upright corner strip or fillet 241 is located in the corner joining the walls 227 and 228. Corner strip 241 provides a concrete box culvert with a beveled corner. Each corner has a corner strip.

Section 221 has an upright flat end plate 242 secured to the first ends of channel beams 231 and 232, wall 228, and angle member 229. The opposite end of section 221 has a second end plate 243 secured to the end of wall 227 and the adjacent portions of angle member 229 and beams 231 and 232. The lower ends of the end plates 242 and 243 are secured to the ends of guide rail 237. End plate 242 carries a pair of outwardly directed horizontal studs or positioning members 244 for aligning the corner unit 223 on end plate 242. Similar studs 244A are secured to end plate 243A to align the opposite end of the corner unit 223 with the right angle section 222. Right angle section 222 is identical to section 221. The parts of sections 222 that correspond with the parts of section 221 have the same reference numerals with the suffix A.

Corner unit 223 corresponds to the corner unit shown in FIGS. 5, 6, and 7, and is identical with the corner unit 224. The parts of corner unit 223 that correspond with the parts of the corner unit shown in FIGS. 5, 6, and 7, have the same reference numerals with the suffix A. The following description is limited to corner unit 223.

As shown in FIGS. 15 and 16, corner unit 223 has an upright wall 263 forming a part of the inside surface of the outer form 220. An upright corner strip or fillet 266 is secured to wall 263 to form the beveled corner of the concrete culvert. A first upright flat end plate 267 is secured to one end of wall 263. End plate 267 is adapted to be positioned in flat surface engagement with the end plate 242 of corner section 221. A second end plate 268 is secured to an upright rib 269. Rib 269 projects a short distance normal to wall 263 to form the corner of the corner unit. End plates 267 and 268 have a plurality of holes for accommodating nut and bolt assemblies 259 and 261 to secure the end plates to the adjacent corner sections. A pair of gusset members 271 extend between rib 269 and end plate 268 to form the right angle corner of the corner unit. A pair of channel beams 272 and 273 extend between and are secured to the end plate 267 and rib 269. Channel beams 272 and 273 are secured with welds or the like to outside of wall 263. Alternatively, channels 272 and 273 may be free of wall 263 thereby allowing wall 263 to have independent limited movement relative to beams 272 and 273.

A right angle top member 274 is secured to the top portions of plate 263 and rib 269. A bottom guide rail 276 is secured to the lower portion of plates 267 and 268 and the rib 269. Positioned above and inwardly of guide rail 276 is an angle member 277 having a continuous downwardly open groove for accommodating a seal, such as the seal 240. Angle member 277 is secured to wall 263 and is in alignment with angle members 238 and 238A. Plate 267 has a pair of holes 278 for accommodating the studs 244. Similar holes 279 are located in plate 268 for accommodating studs 244A. The nut and bolt assemblies 259 and 261 secure the corner unit 223 to right angle wall sections 221 and 222 respectively.

Figure 18:
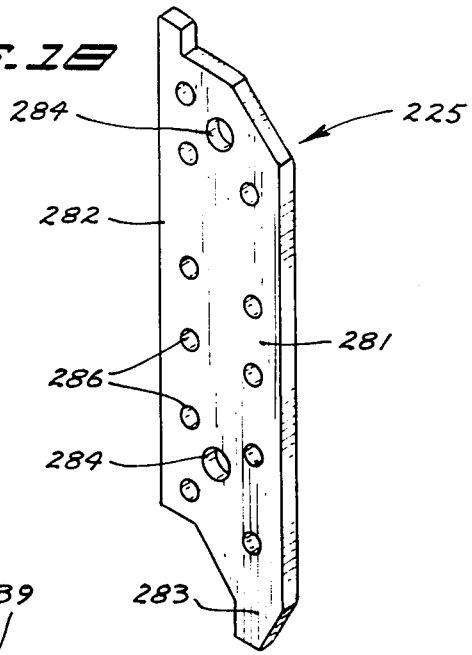
FIG. 18 is a perspective view of a spacer plate used in the outer form of FIG. 15.

Referring to FIG. 18, there is shown a perspective view of spacer plate 225. Spacer plate 226 is identical with spacer plate 225. Plate 225 has an elongated generally flat body 281. The inner edge 282 of the body is flat and forms a small portion of the inside surface of outer form 200. Body 281 has a downwardly directed extension or foot 283 that engages guide rail 237A. Body 281 has a pair of holes 284 for accommodating the positioning studs 244A. Body 281 also has a plurality of holes 286 for accommodating nut and bolt assemblies 261. The width of body 281 can vary in accordance with the desired thickness of the wall of the concrete culvert. In addition, additional spacer plates can be used if an additional wall thickness is needed. Spacer plates can also be used between the end plates 242 and 267 to increase the length or thickness of the ends of the concrete culvert.

Referring to FIG. 19, there is shown the outer form 200 positioned about core 201. The outer form 200 rests on a pallet assembly 105. Pallet assembly 105 surrounds the core 201 and rests on the right angle member 133 and O-ring seal 136. Pallet assembly 105 has a stepped pallet 107 having a lower inwardly directed flange 108 in engagement with the seal 136 and an upwardly and outwardly directed flange. Seal 240 is located in groove 239 of angle member 238 resting on the outer edge of flange 109. Outer form 200 is positioned on pallet 107 by spacer and positioning blocks 287 located in engagement with the inside of guide rails 237. A plurality of bolts 288 secure the blocks 287 to rails 237. A plurality of guide blocks 287 are spaced about rail 237 to locate form 200 in the position on flange 109.

Referring to FIG. 14, when spacer blocks 287 are removed and spacer plates 227 and 226 are detached from form 200, guide rails 237 position the seal 137 inwardly from the outer edge of flange 109, thereby reducing the thickness of the concrete wall 138. This arrangement is shown in FIG. 14.

The dry cast concrete product is formed in the chamber between the side walls of the core and the adjacent side walls of the outer form. The procedure for making a concrete box culvert is the same as described with respect to the use of form 20, pallet assembly 105, and core 123.

Several modifications of the outer form have been disclosed. Each form can be used with a pallet assembly and a core to make a concrete box culvert. Changes in the sizes and shapes of the forms can be made without altering the invention. The invention is set out in the following claims.

We claim:

1. A box form mountable on a pallet assembly for use in making a box concrete culvert comprising: a first right angle section having upright normally disposed first and second walls, and said first wall having a first end, said second wall having a second end, a first outwardly directed upright flange secured to the first end, a second outwardly directed upright flange secured to the second end, a second right angle section having upright normally disposed first and second walls, said first wall of the second right angle section having a third end, said second wall of the second right angle section having a fourth end, a third outwardly directed upright flange secured to the third end, a fourth outwardly directed upright flange secured to the fourth end, reinforcing members secured to said first and second walls of the first and second right angle sections, a first corner unit having first and second normally disposed upright flanges located adjacent the first and fourth flanges, first studs secured to the first and fourth flanges, said first and second flanges of the first corner unit having holes accommodating said first studs to locate the first corner unit on the first and second sections, said flanges of the first corner unit and first and fourth flanges having first aligned holes, first releasable fastening means extended through said first aligned holes to secure the first corner unit to the first and second sections, a second corner unit, having first and second normally disposed upright flanges located adjacent the second and third flanges of the first and second sections, second studs secured to the second and third flanges, said first and second flanges of the second corner unit having holes accommodating the second studs to locate the second corner unit on the first and second sections, said first and second flanges of the second corner unit and said second and third flanges of the first and second sections having second aligned holes, second releasable fastening means extend through the second aligned holes to secure the second corner unit to the first and second sections, and rail means secured to lower portions of the first and second sections below and laterally outward from said first walls and second walls for locating the box form on a pallet assembly.

2. The form of claim 1 wherein: each corner unit is a right angle member having first and second upright walls normally disposed relative to each other.

3. The form of claim 1 including: gusset plates secured to and located between the first and second upright flanges of the first and second corner units.

4. The form of claim 1 wherein: each corner unit has first and second upright walls normally disposed relative to each other, said first wall of each corner unit being longer than said second wall thereof.

5. The form of claim 1 wherein: each corner unit has first and second walls angularly disposed relative to each other.

6. The form of claim 1 including: a rail member secured to the first and second corner units cooperating with the rail means to locate the form on a pallet assembly.

7. The form of claim 1 wherein: the reinforcing members of each section include upright plates secured to the first and second walls thereof, said plates having lower sections, and said rail means being secured to said lower sections to locate the form on a pallet assembly.

8. The form of claim 1 including: spacer plates located between the first flange of the first and second corner units and the second and fourth flanges of the first and second sections.

9. The form of claim 1 including: spacer means located between at least two adjacent flanges of the corner units and first and second sections to change the length of the dimension of the box form.

10. The form of claim 1 wherein: each corner unit has two pair of upright flanges.

11. The form of claim 1 wherein: each corner unit has two pair of upright flanges, each corner unit flange having a lower end, and a rail member secured to the lower end of each corner unit flange cooperating with the rail means to locate the form on a pallet assembly.

12. The form of claim 11 including: a plurality of horizontal members extended between and secured to each pair of upright flanges.

13. The form of claim 1 wherein: each corner unit has three upright flanges.

14. The form of claim 1 wherein: each corner unit is a right angle member having first and second walls, and three upright flanges, two of said three upright flanges being secured to one of said walls of the corner unit and one of said three upright flanges being secured to the other of said walls of the corner unit.

15. The form of claim 14 including: a plurality of horizontal members extended between and secured to said two of said flanges.

16. A box form for use in making a concrete product comprising: first and second wall sections, each wall section having angularly disposed first and second portions, permanently joined together, said first and second portions having two angularly disposed surfaces adapted to form two outside walls of a concrete product, each first portion having a first end, each second portion having a second end, a first corner unit, first releasable means connecting the first corner unit to the first ends of the first portions of the first and second wall sections, a second corner unit, second releasable means connecting the second corner unit to the second ends of the second portions of the first and second wall sections, whereby the first and second corner units can be removed from the first and second wall sections and rail means secured to the first and second wall sections below and laterally outward from said wall sections to locate the box form on a pallet assembly.

17. The box form of claim 16 wherein: each corner unit is a right angle member having upright flanges on opposite ends of the member, said first and second releasable means cooperating with the flanges to connect the corner units to the wall sections.

18. The box form of claim 17 wherein: each corner unit has a plurality of cross members extended between and secured to the flanges.

19. The form of claim 16 wherein: each end of the sections has an outwardly projected upright end flange, and each corner unit has a pair of upright flanges located in side-by-side relation with the end flanges, said first and second means comprising fastening means connecting adjacent flanges of the corner units and sections.

20. The form of the claim 19 including: at least one stud secured to each flange of each section, each flange on the corner units having a hole accommodating a stud.

21. The form of claim 16 wherein: each section has upright plates secured thereto, said plates having lower sections, and said rail means comprising rail member secured to said lower sections to locate the form on a pallet assembly.

22. The form of claim 16 including: spacer plates located between the first end of the first wall section and the first corner unit and between the second end of the second wall section and the second corner unit.

23. The form of claim 16 including: spacer means located between at least one corner unit and one of the wall sections to change the length of one dimension of the box form.

24. The form of claim 16 wherein: each corner unit has two pair of upright flanges, each flange having a lower end, said form including a rail member secured to the lower end of each flange cooperating with the rail means to locate the form on a pallet assembly.

25. The form of claim 24 including: a plurality of horizontal members extended between and secured to each pair of upright flanges.

26. The form of claim 16 wherein: each corner unit has three upright flanges.

27. The form of claim 16 wherein: each corner unit is a right angle member having first and second walls, and three upright flanges, two of said flanges being secured to one of said walls of the corner unit and one of said flanges being secured to the other of said walls of the corner unit.

28. The form of claim 27 including: a plurality of horizontal members extended between and secured to said two of said flanges.

29. A box form mountable on a pallet assembly for use in making a box concrete product comprising: a first right angle section having upright normally disposed first and second walls permanently joined together, said walls having surfaces adapted to form two outside walls of a concrete product, said first wall having a first end, said second wall having a second end, a first outwardly directed upright flange secured to the first end, a second outwardly directed upright flange secured to the second end, a second right angle section having upright normally disposed first and second walls permanently joined together, said first and second walls of the second section adapted to form two outside walls of a concrete product, said first wall of the second right angle section having a third end, said second wall of the second section having a fourth end, a third outwardly directed upright flange secured to the third end, a fourth outwardly directed upright flange secured to the fourth end, a first corner unit having first and second normally disposed upright flanges located adjacent the first and fourth flanges, said flanges of the first corner unit and said first and fourth flanges having first aligned holes, first releasable fastening means extended through said first aligned holes to secure the first corner unit to the first and second sections, a second corner unit having first and second normally disposed upright flanges located adjacent the second and third flanges of the first and second sections, said first and second flanges of the second corner unit and said second and third flanges having second aligned holes, and second releasable fastening means extend through the second aligned holes to secure the second corner unit to the first and second sections, and rail means secured to lower portions of the first and second right angle sections below and laterally outward from the first and second walls of said sections for locating the box form on a pallet assembly.

30. The form of claim 29 including: a rail member on at least one corner unit cooperating with the rail means for locating the box form on a pallet assembly.

31. The form of claim 29 wherein: each corner unit is a right angle member having first and second upright walls normally disposed relative to each other

32. The form of claim 29 including: gusset plates secured to and located between the first and second upright flanges of the first and second corner units.

33. The form of claim 29 wherein: each corner unit has first and second upright walls normally disposed relative to each other, said first wall of each corner unit being longer than said second wall thereof.

34. The form of claim 29 including: a rail member secured to the first and second corner units cooperating with the rail means to locate the form on a pallet assembly.

35. The form of claim 29 including: spacer plates located between the first flange of the first and second corner units and the second and fourth flanges of the first and second sections.

36. The form of claim 29 including: spacer means located between at least two adjacent flanges of the corner units and first and second sections to change the length of one dimension of the box form

37. The form of claim 29 wherein: each corner unit has two pair of upright flanges.

38. The form of claim 29 wherein: each corner unit has two pair of upright flanges, each flange of said pair of upright flanges having a lower end, and a rail member secured to the lower end of each flange cooperating with the rail means to locate the form on a pallet assembly.

39. The form of claim 38 including: a plurality of horizontal members extended between and secured to each pair of upright flanges.

40. The form of claim 29 wherein: each corner unit has three upright flanges.

41. The form of claim 29 wherein: each corner unit is a right angle member having first and second walls, and three upright flanges, two of said three upright flanges being secured to one of said walls of the corner unit and one of said three upright flanges being secured to the other of said walls of the corner unit.

42. The form of claim 41 including: a plurality of horizontal members extended between and secured to said two of said flanges.

* * * * *